US009149854B2

(12) United States Patent
Zhou et al.

(10) Patent No.: US 9,149,854 B2
(45) Date of Patent: Oct. 6, 2015

(54) STAMPING APPARATUS

(75) Inventors: Dajun Zhou, Troy, MI (US); Changqing Du, Troy, MI (US); Yang Hu, Lake Orion, MI (US); Yongjun Zhou, Rochester Hills, MI (US)

(73) Assignee: FCA US LLC, Auburn Hills, MI (US)

( * ) Notice: Subject to any disclaimer, the term of this patent is extended or adjusted under 35 U.S.C. 154(b) by 788 days.

(21) Appl. No.: 13/100,346

(22) Filed: May 4, 2011

(65) Prior Publication Data

US 2012/0279272 A1 Nov. 8, 2012

(51) Int. Cl.

| | |
|---|---|
| ***B21D 22/22*** | (2006.01) |
| ***B21D 24/04*** | (2006.01) |
| ***B21D 22/02*** | (2006.01) |

(52) U.S. Cl.

CPC ..... *B21D 22/22* (2013.01); *B21D 22/02* (2013.01); *B21D 24/04* (2013.01)

(58) Field of Classification Search

CPC ..... B21D 22/02; B21D 24/04; B21D 24/10; B21D 22/10; B21D 22/26; B21D 26/021; B21D 22/20; B21D 22/22

USPC ..... 72/350, 351, 297, 296, 304, 305, 414, 72/348

See application file for complete search history.

(56) References Cited

U.S. PATENT DOCUMENTS

| | | | | |
|---|---|---|---|---|
| 3,664,172 | A * | 5/1972 | Cvacho | 72/350 |
| 4,432,222 | A | 2/1984 | Ujihara et al. | |
| 4,576,030 | A * | 3/1986 | Roper | 72/296 |
| 5,372,026 | A * | 12/1994 | Roper | 72/350 |
| 5,600,991 | A | 2/1997 | Munzen | |
| 5,901,599 | A * | 5/1999 | Sato et al. | 72/350 |
| 6,032,504 | A | 3/2000 | Onat et al. | |
| 6,196,043 | B1 | 3/2001 | Ehardt | |
| 6,745,604 | B1 * | 6/2004 | Morales | 72/350 |
| 7,086,265 | B2 | 8/2006 | Lösch | |
| 7,861,568 | B2 * | 1/2011 | Nakamura et al. | 72/350 |
| 7,954,353 | B2 * | 6/2011 | Birkenstock et al. | 72/347 |
| 2012/0180542 | A1 * | 7/2012 | Golovashchenko | 72/350 |

* cited by examiner

*Primary Examiner* — Shelley Self
*Assistant Examiner* — Mohammad I Yusef
(74) *Attorney, Agent, or Firm* — Ralph E. Smith

(57) ABSTRACT

The present disclosure provides stamping apparatus for stamping a blank. The stamping apparatus includes a first die and a blank-holding ram. The first die includes a forming cavity and a depression positioned outboard of the forming cavity. The depression is defined by a first corner proximate the forming cavity and a second corner distal the forming cavity in the outboard direction from the first corner and the forming cavity. The blank-holding ram includes a bead configured to engage a portion of the blank into the depression when the blank is positioned between the first die and the blank-holding ram. The bead includes a third corner proximate the forming cavity and a fourth corner surface distal the forming cavity in the outboard direction from the third corner. The first corner of the depression includes a radii of curvature greater than a radii of curvature of the second corner of the depression and the radii of curvature of the third and fourth corners of the bead.

20 Claims, 3 Drawing Sheets

STAMPING APPARATUS

FIELD

The present invention relates to stamping apparatus, and in particular, stamping apparatus having a lock-bead for securing a blank to be stamped.

BACKGROUND

Stamping apparatus can be used to form or "stamp" a metal blank into a formed part that is used for a panel, for example, for a vehicle. In many stamping apparatus, the metal blank is securely held between upper and lower dies of the stamping apparatus during a stamping process where a blank-holding ram engages a portion of the blank to secure or hold the blank so a punch can engage another portion of the held blank into a forming cavity to stamp or form the part. To ensure that the blank is held as desired during the stamping process the blank-holding ram may include a bead is configured to engage the blank into a depression formed in the lower die. In some configurations, multiple beads positioned alongside each other may be utilized to increase the blank holding force during the stamping process. High tensile strains experienced by the blank proximate the bead(s), however, may cause the blank to break during the stamping process, which may render the blank unusable. Additionally, configurations having multiple beads alongside each other result in more scrap and higher manufacturing costs.

SUMMARY

The present disclosure provides a stamping apparatus for stamping a blank. The stamping apparatus includes a first die and a blank-holding ram. The first die includes a forming cavity and a depression positioned outboard of the forming cavity. The depression is defined by a first corner proximate the forming cavity and a second corner distal the forming cavity in the outboard direction from the first corner and the forming cavity. The blank-holding ram includes a bead configured to engage a portion of the blank into the depression when the blank is positioned between the first die and the blank-holding ram. The bead includes a third corner proximate the forming cavity and a fourth corner surface distal the forming cavity in the outboard direction from the third corner. The first corner of the depression includes a radii of curvature greater than a radii of curvature of the second corner of the depression and the radii of curvature of the third and fourth corners of the bead.

In another aspect of the present disclosure, the radius of curvature of the first corner is at least twice as great as the radii of curvature of the second, third and fourth corners.

In another aspect of the present disclosure, the radius of curvature of the first corner is at least three times as great as a thickness of the blank.

In another aspect of the present disclosure, the radius of curvature of the first corner is at least four times as great as a thickness of blank and the radii of curvature of the third and fourth corners is 1.0 to 2.0 times as great as a thickness of the blank.

In another aspect of the present disclosure, a surface from which the depression depends from is angled with respect to a horizontal ground reference.

In another aspect of the present disclosure, a plurality of beads engage respective depressions around the perimeter of the forming cavity, and at least some of the plurality of beads and respective depressions have the corners radii relationship of the bead and depression of claim 1.

Further areas of applicability of the teachings of the present disclosure will become apparent from the detailed description, claims and the drawings provided hereinafter. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

Figure 1:
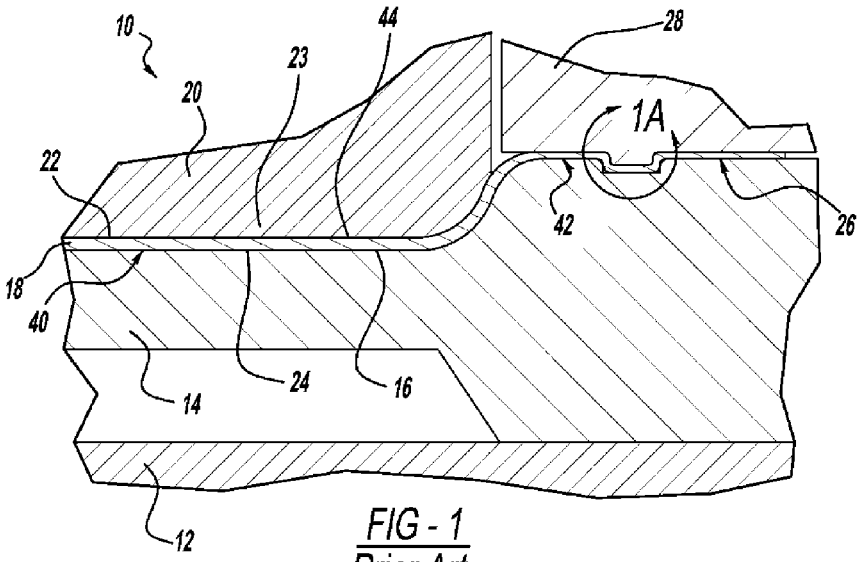
FIG - 1 Prior Art
FIG. 1 is a partial cross-sectional view of a conventional stamping apparatus.

Disclosed herein are exemplary embodiments of a stamping apparatus having a bead-depression configuration where a corner of the depression, proximate the forming cavity of the stamping apparatus, has a radii of curvature larger than the radii of curvature of the distal corner of the depression. The corner of the depression with the larger radii of curvature is also larger than the radii of curvatures of the corners of the bead configured to engage a portion of a blank into the depression.

The bead-depression configuration is configured so the bead engages a portion of the blank into the depression for the purpose of holding the blank during stamping of a portion of the blank into the forming cavity. The radii of curvature relationship of the bead-depression corners results in a substantial increase in holding or locking force of the blank during the stamping process in that the potential locking force substantially approaches the ultimate tensile force capacity of the blank without breaking the blank during the stamping process. Before describing a stamping apparatus according to the present disclosure, a prior art stamping apparatus will be described with reference to FIG. 1. In general, a stamping apparatus 10 comprises a stationary base member 12 constituted by a bolster plate having a stationary lower or constraining die 14 fixedly supported thereon. Constraining die 14 is formed with an upwardly open forming cavity 16 that is shaped according to the desired shape of a formed article, here a sheet metal blank 18 to be stamped or formed.

Above the constraining die 14 is positioned an upper die or drawing ram 20 that is actuatable downwardly and upwardly by a main mechanical or hydraulic power cylinder, for example, (not shown). Drawing ram 20 has lower surface portion 22 defining a drawing punch 23 correspondingly shaped to a surface 24 that defines forming cavity 16 in constraining die 14. Drawing ram 20 is thus movable toward and away from forming cavity 16 in constraining die 14 as drawing ram 20 is driven to move downwardly and upwardly, respectively, by the main power cylinder. Constraining die 14 has a raised land portion 26 surrounding or juxtaposing cavity 16.

Figure 1A:
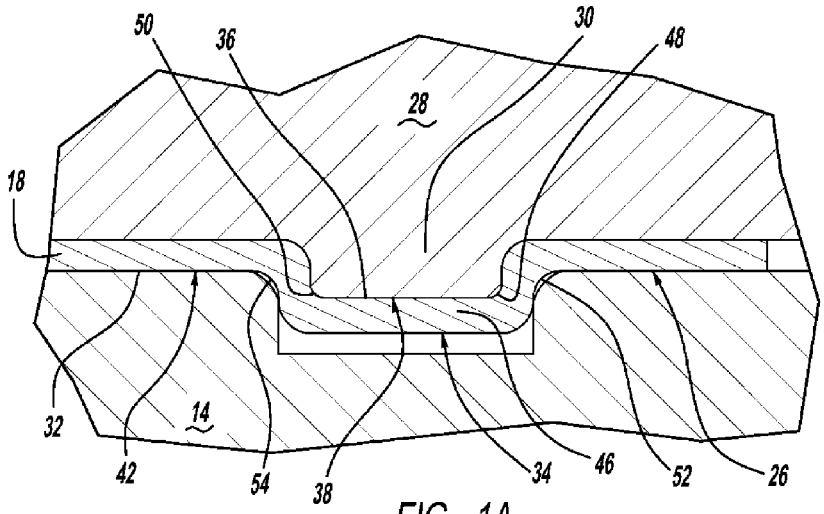
FIG - 1A Prior Art
FIG. 1A is an expanded view of a conventional lock bead-depression configuration illustrated in FIG. 1.

Above land portion 26 of constraining die 14 is positioned a blank-holding ram 28 that is actuatable downwardly and upwardly by an auxiliary power cylinder (not shown). As best shown in FIG. 1A, blank-holding ram 28 defines blank-holding punch 30, which is thus movable toward and away from land portion 26 of constraining die 14 as blank-holding ram 28 is driven to move downwardly and upwardly, respectively, by the auxiliary power cylinder. Land portion 26 of constraining die 14 has a flat upper surface 32 constituting a first blank-holding surface extending around or along cavity 16 in constraining die 14 of an upwardly open depression 34. On the other hand, blank-holding punch 30 has a flat lower surface 36 constituting a second blank-holding surface that is formed with a bead 38 aligned with depression 34, respectively. Although only a portion of stamping apparatus 10 is illustrated in FIG. 1, it should be understood that bead 38 engaged with depression 34 may be configured to extend around an entire perimeter of constraining die 14, or be configured to be disposed on portions of sides of cavity 16.

Before the drawing punch 23 comes into contact with sheet metal blank 18, blank-holding punch 30 is brought into pressing contact with sheet metal blank 18 and thereby has blank 18 or, more specifically, edge portion 42 of blank 18 clamped between blank-holding surface 32 of land portion 26 and blank-holding surface 36 of blank-holding punch 30. As a result, bead 38 of blank-holding punch 30 force some of portion 42 of blank 18 to extend into depression 34 in land portion 26. Edge portion 42 of sheet metal blank 18 is then forcefully gripped between blank-holding surfaces 32 and 36 not only by the pressure exerted between surfaces 32 and 36, but effectively by engagement between blank-holding punch 30 and land portion 26 of constraining die 14 through bead 38 and depression 34.

After sheet metal blank 18 is thus clamped firmly between blank-holding surfaces 32 and 36, drawing punch 23 is brought into pressing engagement with blank 18 and forces blank 18 to stretch into forming cavity 16 formed in constraining die 14 until blank 18 is forced against surface 24 defining forming cavity 16. Upon completion of the drawing operation performed as described above, edge portion 42 of blank 18 now having a series of crimp 46 formed in edge portion 42 is cut off from blank 18. An article (not shown) such as, for example, a side panel of a vehicle that is shaped conformingly to forming cavity 16 in constraining die 14 is thus obtained.

A drawback of the prior art stamping apparatus 10 described above includes that sheet metal blank 18 experiences tensile strains at edge portion 42 of blank 18 in lateral directions at positions that correspond to bead 38 of blank-holding ram 28 and depression 34 formed in constraining die 14. In particular, referring to FIG. 1A, bead 38 includes corners 48 and 50 and depression 34 includes corners 52 and 54.

During the stamping process, edge portion 42 of blank 18 is urged toward forming cavity 16, but is retained due to engagement between blank-holding punch 30 and land portion 26. Due to edge portion 42 being drawn toward forming cavity 16 and being retained between blank-holding punch 30 and land portion 26, blank 18 experiences elevated tensile strains in a lateral direction (i.e., to the left in the figure), which are influenced by the radii at locations of corners 48, 40, 52, and 54. In particular, blank 18 experiences the most tensile strain proximate corner 54 of depression 34. Due to the elevated tensile strains in the lateral direction at corner 54, blank 18 may break, which may cause the part to be drawn further into forming cavity 16 than desired, which results in an incorrectly stamped part that may require it to be discarded. Discarding the incorrectly stamped part increases material costs, which drives up manufacturing costs associated with manufacturing stamped parts.

To account for the increased tensile strains experienced at edge portion 42 in the lateral direction, the present disclosure provides a stamping apparatus with a bead-depression configuration that substantially minimizes the tensile strains experienced during drawing and forming of blank 18 into a stamped formed part and increases the locking or holding force with which the blank is held during the stamping/forming of the blank.

Figure 2:
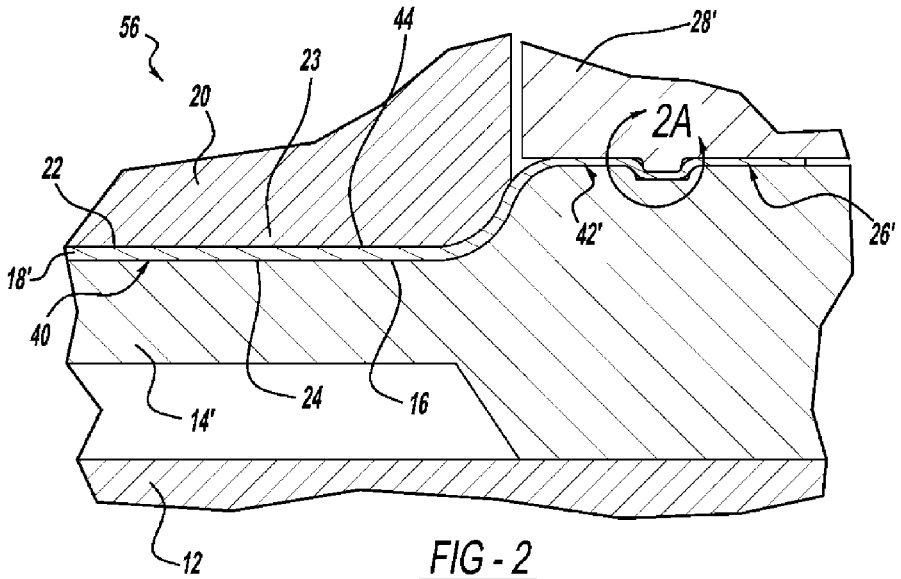
FIG. 2 is a partial cross-sectional view of a stamping apparatus according to the present disclosure.
Figure 2A:
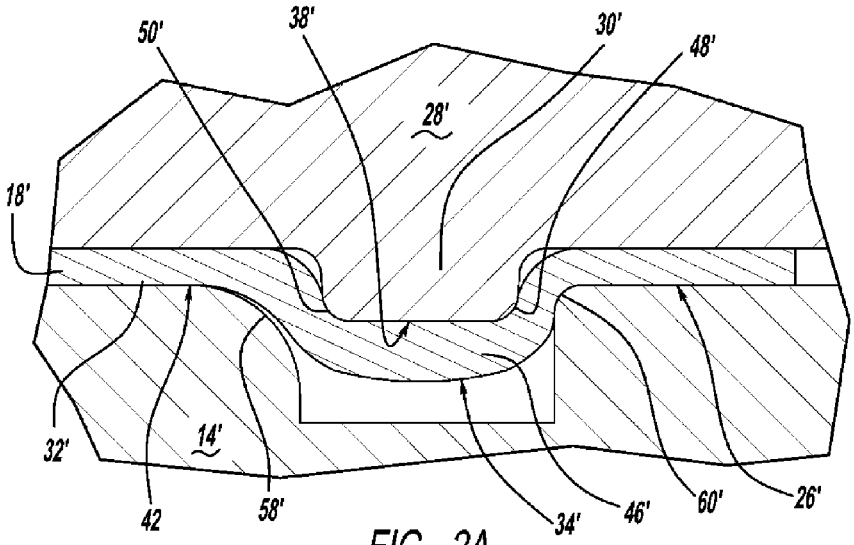
FIG. 2A is an expanded view of a lock bead-depression configuration illustrated in FIG. 2 according to the present disclosure.

Now referring to an exemplary embodiment as shown in FIG. 2, the present disclosure provides a stamping apparatus 56 that, similar to prior art stamping apparatus 10, includes support member 12, a first die 14', a drawing ram 20, and a blank-holding ram 28'. First die 14' includes a land portion 26'. A depression 34' is defined in part by corners 58' and 60', where corner 58' is proximate the forming cavity 16 and corner 60 is distal the cavity in the outboard direction from the first corner. Blank-holding ram 28' includes a blank-holding punch 30' that defines a bead 38' having corners 48' and 50', wherein the corners 48' and 50' of the bead 38' are configured to engage a portion of the blank 18" into the depression 34' as shown in FIG. 2A. Stamping apparatus 56 differs from prior art stamping apparatus 10 having a bead-depression configuration in that a depression 34' of land portion 26' includes at least one corner 58' that has a larger radius of curvature than corners 48' and 50' of bead 38' and corner 60' of depression 34', wherein the corner 58' is nearest the forming cavity 16 (compared to corner 60) where the cavity is configured to receive the blank 18' for having a shape formed/stamped thereon.

In some embodiments, corner 58' may have a radius of curvature at least twice a radius of curvature of corners 48', 50', and 60'. It should be understood that a configuration of a bead(s), depression(s) and the radii of curvature of the corners may be selected based on factors such as the configuration of the dies, punches, the configuration of the forming cavity, the formed part, the material and a thickness of blank 18'. In this regard, when stamping a blank 18' formed of steel, for example, the radius of curvature of corner 58' may be up to four times greater than the radii of corners 48', 50', and 60'. If aluminum blanks are being stamped, the radius of curvature of corner 58' may be between five and six times greater than radii 48', 50', and 60'. Aluminum blanks may require a greater radius of curvature to account for aluminum being a more brittle metal than steel, which results in aluminum not being able to withstand increased tensile strains as well as steel.

In one exemplary embodiment as illustrated in FIG. 2A, depression 34' includes corners 58' 60', and bead 34' includes corners 48' and 50', where corner 58' has a radii of curvature greater than corners 48', 50' of bead 38' and corner 60' of depression 34', and where corner 60' has a radii of curvature greater than corners 48' and 50'. In another exemplary embodiment, corner 58' has radii of curvature at least four times a thickness of the blank while corners 60', 48' and 50' have lesser radii of curvature. In another exemplary embodiment, corner 58' has radii of curvature at least three times a thickness of the blank while corners 60', 48' and 50' have lesser radii of curvature.

When at least corner 58' has a greater radius of curvature compared to corners 48', 50' and 60' damage to blank 18' is prevented, or at least substantially minimized. In this regard, a greater radius of curvature at corner 58' reduces tensile stresses experienced by blank 18' which minimizes blank 18' from breaking during the stamping process and, in turn, minimizes blank 18' from being drawn toward forming cavity 16' to an extent greater than desired to stamp blank 18' into a formed part. A bead-depression configuration where the corner radii 58' is larger compared to the other three corners increases the clamping or locking force capability of the blank proximate the bead. A larger locking force is desirable so the maximum tension force that the blank material can be subjected to during the stamping operation is closer to the maximum tension allowable force corresponding to the ultimate tensile strength of the material. This is desirable in that higher stamping loads may be applied to the blank during stamping of the blank, loads that approach the maximum tensile strength of the blank material without breaking the blank. Additionally, the use of a single bead and corresponding depression, having the radii relationship discussed above, also provides less material compared to the use of a double or trip bead configuration and consequently less scrape material to be removed subsequent to formation of the blank.

In some exemplary embodiments, corner 58' has a radius to blank thickness (R/t) ratio of at least 4, while corners 48', 50' and 60' have a smaller R/t ratio, for example, a R/t ratio of 1.0 to 2.0.

Figure 2B:
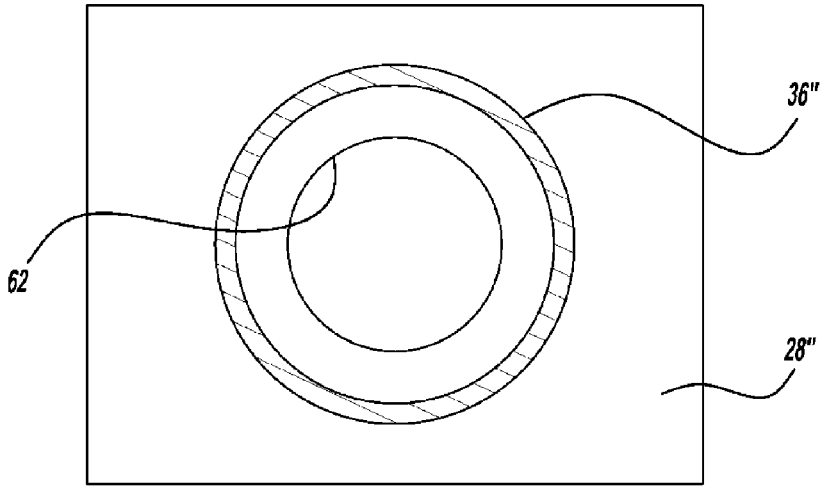
FIG. 2B is an exemplary embodiment of a blank-holding ram having an exemplary bead configuration.

A bead-depression configuration where the radii of corner 58' is larger than the radii of corners 48', 50' and 60' allows the utilization a single bead to provide desirable locking or clamping force of the blank during the stamping process. For instance, in some embodiments a single bead is positioned near an inner edge 62 of a blank-holding ram 28" proximate outer edge of the forming cavity wherein the bead 38" is continuous around the perimeter of the forming cavity, for example as is shown in FIG. 2B.

Figure 2C:
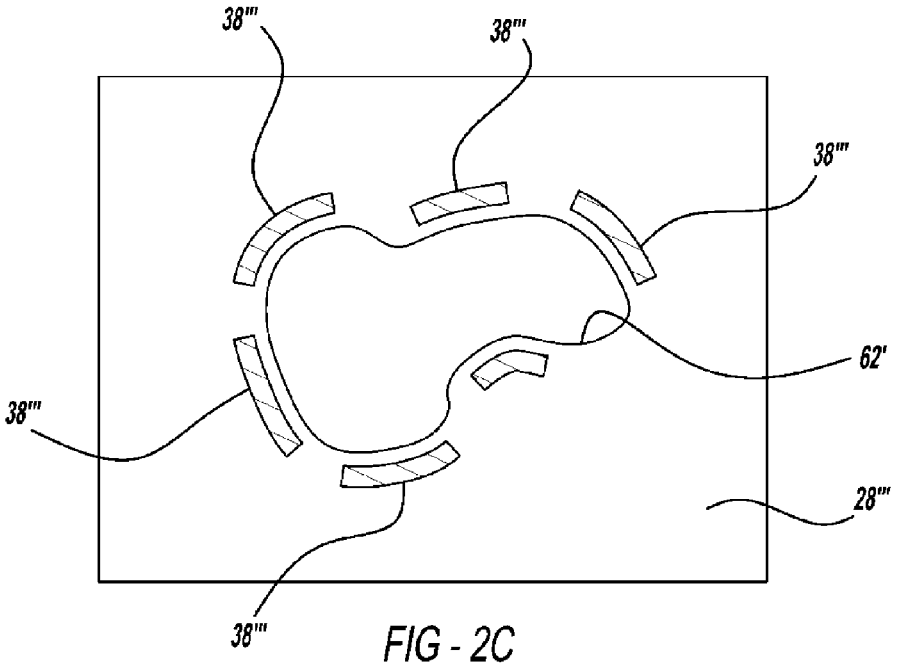
FIG. 2C is another exemplary embodiment of a blank-holding ram having an exemplary bead configuration.

In other embodiments, instead of a single-continuous bead a plurality of beads 38'" are positioned near an inner edge 62' (punch opening line) of a blank-holding ram 28'" proximate an outer edge of the forming cavity, for example as shown in FIG. 2C. Two beads are not positioned alongside each other because one bead at any location alongside the forming cavity provides adequate blank locking force due to the radii configuration of corner 58' described hereinabove.

Of course in some embodiments, it may not be necessary to have beads alongside a particular portion of the forming cavity. In some embodiments, the stamping apparatus may be configured so not all of one or more depressions receive a bead. Additionally, in some embodiments having a plurality of beads, a portion of the plurality of beads are lock beads (having the radii relationship with the respective depression as described hereinabove) while another portion of the plurality of the beads are draw beads. A draw bead configuration may be utilized for example in the exemplary embodiment of FIG. 2C. In the stamping industry, lock beads are configured to hold the blank such that blank material proximate the bead is substantially impeded from flowing toward the forming cavity. Draw beads are configured so a portion of blank material proximate the bead flows toward the forming cavity in a desired, controlled manner, depending on the configuration of the forming cavity, the configuration and material of the part to be stamped, the stamping apparatus, etc.

The embodiments of bead-depression configurations discussed herein are intended for use with stamping apparatus where the punch is actuated substantially in the vertical direction with respect to a horizontal ground reference and where the surface from which the depression depends from is substantially horizontal with respect to the ground reference. The embodiments of bead-depression configurations discussed herein are also intended for use with stamping apparatus where the surface (e.g. land surface) from which depression depends from is angled with respect to the horizontal ground reference.

Radius of curvature of corner 58' is predetermined prior to formation of stamping apparatus 56. That is, it is generally predetermined what types of blanks 18' that stamping apparatus 56 will stamp during its useful life. If stamping apparatus 56 will be used for stamping aluminum blanks, radius of curvature of corner 58' may be predetermined using finite elemental analysis (FEA) to determine the magnitude of tensile strains experienced by blank 18' prior to manufacture of stamping apparatus 56.

Such a process can increase the useful life of stamping apparatus 56. That is, when tensile strains experienced by blank 18' are reduced, the amount of wearing at corners 48', 50', 58', and 60' is reduced as well. This increases the useful life of stamping apparatus 56 in that a greater amount of stampings may be produced before stamping apparatus is serviced or replaced. This, in turn, reduces manufacturing costs associated with producing the formed parts.

What is claimed is:

1. A stamping apparatus for stamping a blank, the apparatus comprising:

a first die including a forming cavity and a plurality of depressions positioned outboard and along a periphery of said forming cavity in a non-overlapping manner, said depressions each defined by a first corner proximate said forming cavity and a second corner distal said forming cavity in the outboard direction from said first corner and said forming cavity; and a blank-holding ram including a plurality of beads each configured to engage an edge portion of said blank into said depressions when the blank is positioned between the first die and the blank-holding ram, said beads each including a third corner proximate said forming cavity and a fourth corner distal said forming cavity in the outboard direction from said third corner, wherein said first corner of said depression includes a radii of curvature greater than the radii of curvatures of said second corner of said depression, and the third and fourth corners of the bead, and the first corner is located distal from the edge portion of the blank.

2. The stamping apparatus of claim 1, wherein said radius of curvature of said first corner is at least twice as great as said radii of curvature of said second, third and fourth corners.

3. The stamping apparatus of claim 1, wherein said radius of curvature of said first corner is at least three times as great as said radii of said second, third and fourth corners.

4. The stamping apparatus of claim 1, wherein said radius of curvature of said first corner is at least two times as great as said radii of said third and fourth corners.

5. The stamping apparatus of claim 1, wherein said radius of curvature of said first corner is at least three times as great as a thickness of the blank.

6. The stamping apparatus of claim 1, wherein said radius of curvature of said first corner is at least four times as great as a thickness of the blank.

7. The stamping apparatus of claim 1, wherein said radius of curvature of said first corner is at least four times as great as a thickness of blank and said radii of curvature of said third and fourth corners is 1.0 to 2.0 times as great as a thickness of the blank.

8. The stamping apparatus of claim 1, wherein a surface from which said depression depends from is angled with respect to a horizontal ground reference.

9. The stamping apparatus of claim 1, wherein said bead extends entirely about a perimeter of said forming cavity.

10. The stamping apparatus of claim 7, wherein said bead engages said depression entirely about the perimeter of said forming cavity.

11. The stamping apparatus of claim 1, further comprising a punch configured to engage a portion of the blank into the forming cavity.

12. A stamping apparatus for stamping a blank, the apparatus comprising:

a first die including a forming cavity and a depression positioned outboard of the forming cavity, the depression defined by a first corner proximate the forming cavity and a second corner distal the forming cavity in the outboard direction from the first corner and the forming cavity; and a blank-holding ram including a bead configured to engage an edge portion of the blank into the depression when the blank is positioned between the first die and the blank-holding ram, the bead protruding from the blank-holding ram and including a lower surface positioned between a pair of side surfaces that extend orthogonal to the lower surface, the side surfaces connecting to the lower surface by way of a third corner proximate the forming cavity and a fourth corner distal the forming cavity in the outboard direction from the third corner, wherein the first corner of the depression includes a radii of curvature greater than the radii of curvatures of the corner of the depression, and the third and fourth corners of the bead, and the first corner is located distal from the edge portion of the blank.

13. The stamping apparatus of claim 12, wherein said radius of curvature of said first corner is at least twice as great as said radii of curvature of said second, third and fourth corners.

14. The stamping apparatus of claim 12, wherein said radius of curvature of said first corner is at least three times as great as said radii of said second, third and fourth corners.

15. The stamping apparatus of claim 12, wherein said radius of curvature of said first corner is at least two times as great as said radii of said third and fourth corners.

16. The stamping apparatus of claim 12, wherein said radius of curvature of said first corner is at least three times as great as a thickness of the blank.

17. The stamping apparatus of claim 12, wherein said radius of curvature of said first corner is at least four times as great as a thickness of the blank.

18. The stamping apparatus of claim 12, wherein said radius of curvature of said first corner is at least four times as great as a thickness of blank and said radii of curvature of said third and fourth corners is 1.0 to 2.0 times as great as a thickness of the blank.

19. The stamping apparatus of claim 12, wherein said bead extends entirely about a perimeter of said forming cavity.

20. The stamping apparatus of claim 12, wherein the first die includes a plurality of the depressions positioned outboard and along a periphery of the forming cavity in a non-overlapping manner; and the blank-holding ram includes a plurality of the beads each configured to engage the depressions.

* * * * *